US006595825B1

(12) United States Patent
De Wilde

(10) Patent No.: US 6,595,825 B1
(45) Date of Patent: Jul. 22, 2003

(54) MODULAR CONSTRUCTION SYSTEM WITH ROTATING COUPLING

(75) Inventor: Gerrit Jan De Wilde, Gramsbergen (NL)

(73) Assignee: Wild-Design Holding GmbH, Luxembourg (LU)

( * ) Notice: Subject to any disclaimer, the term of this patent is extended or adjusted under 35 U.S.C. 154(b) by 0 days.

(21) Appl. No.: 09/530,791

(22) PCT Filed: Nov. 4, 1998

(86) PCT No.: PCT/EP98/07205

§ 371 (c)(1),
(2), (4) Date: May 3, 2000

(87) PCT Pub. No.: WO99/22834

PCT Pub. Date: May 4, 1999

(30) Foreign Application Priority Data

Nov. 4, 1997 (NL) ..... 1007436

(51) Int. Cl.[7] ..... A63H 33/12

(52) U.S. Cl. ..... 446/102; 446/122; 446/85; 403/348

(58) Field of Search ..... 446/102, 103, 446/104, 86, 85, 120, 121; 403/359.1, 359.2, 348, 349, 350, 351; 52/656.9, 653.1

(56) References Cited

U.S. PATENT DOCUMENTS

| | | | | | |
|---|---|---|---|---|---|
| 281,618 | A | * | 7/1883 | Crowell | 403/359.2 |
| 3,195,266 | A | * | 7/1965 | Onanian | 52/603 |
| 4,065,890 | A | * | 1/1978 | Fenner | 403/349 |
| 4,176,493 | A | * | 12/1979 | Dideriksen | 446/102 |
| 4,353,705 | A | * | 10/1982 | Scott-Jackson et al. | 403/359.2 |
| 4,389,808 | A | * | 6/1983 | Podell et al. | 446/86 |
| 4,551,110 | A | * | 11/1985 | Selvage et al. | 446/122 |
| 4,632,195 | A | * | 12/1986 | Emmerich | 403/348 |
| 4,632,437 | A | * | 12/1986 | Robson et al. | 403/350 |
| 4,664,252 | A | * | 5/1987 | Galbraith | 193/37 |
| 5,035,398 | A | * | 7/1991 | Chiang | 403/348 |
| 5,094,643 | A | * | 3/1992 | Bolli et al. | 403/348 |
| 5,626,435 | A | * | 5/1997 | Wohlhuter | 403/348 |
| 6,108,944 | A | * | 8/2000 | Savoie | 403/348 |
| 6,254,303 | B1 | * | 7/2001 | Falat et al. | 403/348 |
| 6,302,617 | B1 | * | 10/2001 | Rumpp | 403/348 |

FOREIGN PATENT DOCUMENTS

| | | | | |
|---|---|---|---|---|
| DE | 3602630 A1 | * | 7/1987 | A63H/33/10 |
| EP | 0067249 | | 12/1982 | |
| EP | 0162730 | | 11/1985 | |
| FR | 2568669 A1 | * | 2/1986 | A63H/33/10 |
| WO | 9717687 | | 5/1997 | |
| WO | 9725121 | | 7/1997 | |

* cited by examiner

*Primary Examiner*—Derris H. Banks
*Assistant Examiner*—Urszula M Cegielnik
(74) *Attorney, Agent, or Firm*—Webb Ziesenheim Logsdon Orkin & Hanson, P.C.

(57) ABSTRACT

A modular construction system has at least two profile parts for releasable coupling with a coupling part. The coupling part has on each of at least two sides one or more radially protruding lips. The lips on one side may be rotated to engage a portion of a profile part while the lips on another side may be rotated to engage a portion of another profile part, thereby securing the profile parts to one another.

20 Claims, 12 Drawing Sheets

FIG. 12
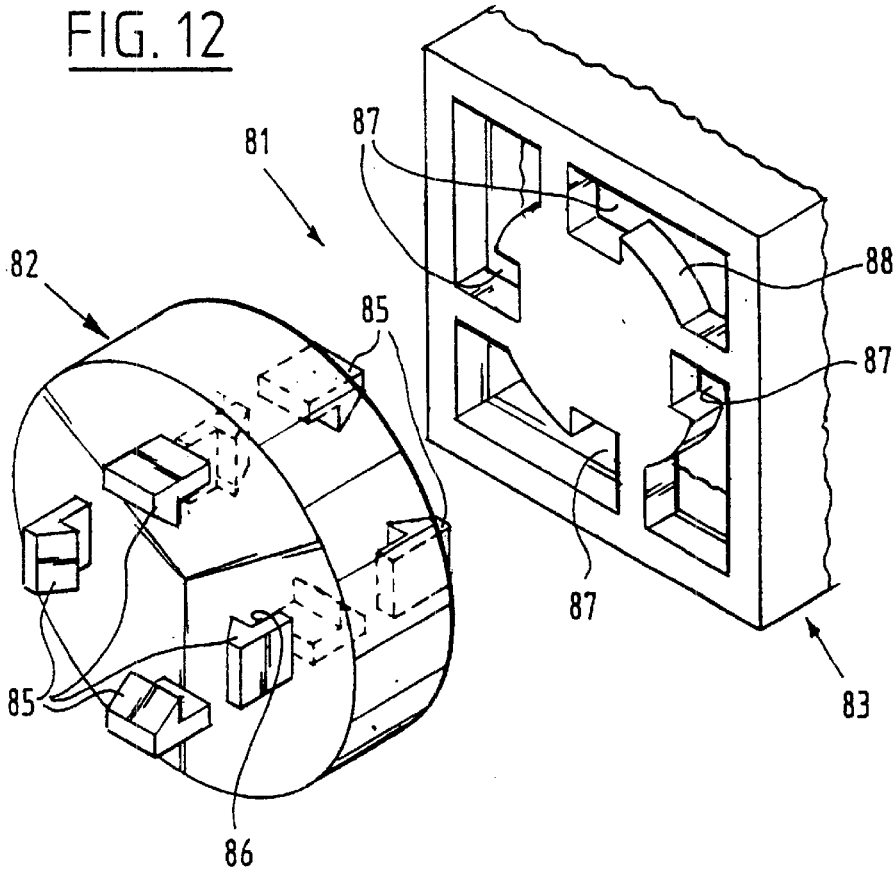
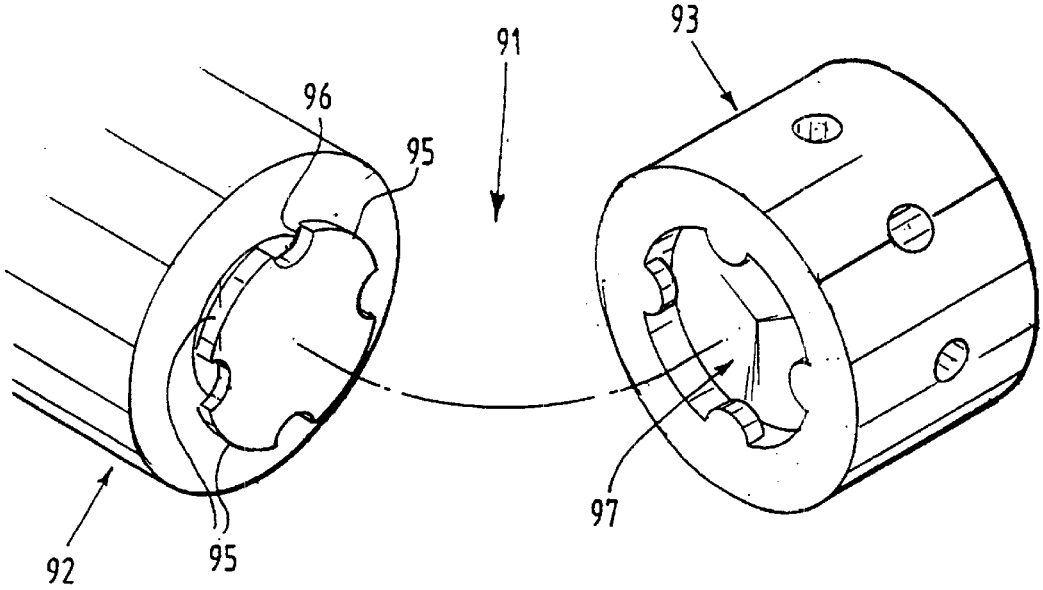
FIG. 13

MODULAR CONSTRUCTION SYSTEM WITH ROTATING COUPLING

BACKGROUND OF THE INVENTION

The invention relates to a modular construction system, for instance for educational purposes or for use as toy, which system comprises at least two profile parts for mutual releasable coupling by means of a coupling part, wherein the coupling part is provided on at least two different sides thereof with one or more radially protruding lips and a recessed portion present behind the lips as seen in coupling direction, and wherein each profile part is provided in at least one wall thereof with a continuous opening with different dimensions as seen in at least two different radial directions, wherein the larger dimension is larger than or equal to the maximum radial section through the lips and wherein the smaller dimension is smaller than said radial section, wherein the wall thickness at the position of the opening is smaller than or equal to the width of the recessed portion on the coupling part, this such that coupling takes place by receiving of the lips in the opening and by subsequent radial rotation of the coupling part and each profile part relative to each other.

SUMMARY OF THE INVENTION

In the modular construction system according to the invention the components can only be pushed into each other at particular mutual orientations and then be coupled by means of rotation. By playing with this toy the spatial awareness of children can be developed at a young age. By adapting for instance the number of lips or the complexity of the shape of the opening in combination with the size, the toy can be made suitable for children in most age groups. The described rotating coupling can in addition withstand relatively high loads, which provides the option of giving components of the modular construction system a heavier and therefore larger form. By giving for instance the profile parts a relatively large form, it is possible to obtain a comparatively large construction volume within a short time by mutually coupling a number of these profile parts. Particularly in the use as toy, this will have a highly motivating effect on a child. It is noted moreover that to the best of applicant's knowledge this aspect is not provided for by other toys. The thus embodied profile parts and coupling parts can furthermore be manufactured especially well using known injection moulding techniques.

In a first preferred embodiment the coupling part is provided with two or more lips on each of the at least two different sides. In a second preferred embodiment there are four lips.

In a further preferred embodiment the coupling part comprises at least two sets of one or more lips fixed to a central part, wherein the recessed portion associated with each set of lips is bounded by the lips and the central part. In order to bring about a precise mutual connection of the profile parts and coupling parts, the transverse shape of the central part is preferably substantially the same as the transverse shape of the profile part. In a further development of this preferred embodiment, each profile part comprises in the wall provided with the opening a recess for receiving at least a portion of the central part. In the coupled situation of two profile parts the relevant coupling part is in this way concealed from view. In order to facilitate handling, grooves running parallel to the coupling direction can be arranged on the central part, for instance for co-action with a tool. In another preferred embodiment the central part is embodied substantially in the shape of a cube. A set of one or more lips can herein be arranged on all six sides of the cube-shaped central part. Such a coupling part enables the construction of many structures, also more complicated ones. In another preferred embodiment the form and dimensions of at least one of the walls of each profile part provided with the opening are the same as the form and dimensions of the walls of the cube-shaped central part. In this embodiment the cube-shaped coupling part defines as it were a basic unit or basic module. By choosing the dimensions of the profile parts for instance such that these correspond with a whole number of times the dimensions of the basic module, larger units can for instance be constructed with a shape analogous to the basic module.

The coupling part is preferably embodied mirror-symmetrically as seen in transverse direction. This has the advantage among others that the coupling part is simpler to manufacture. In addition, the mirror-symmetrical embodiment provides the option of constructing generally mirror-symmetrical structures.

In yet another preferred embodiment, the sets of lips are mounted rotatably on the central part. Using a specific tool, which can for instance be placed through another opening on the profile part, the lips can then be rotated into the desired position.

In the simplest form the opening is square. In a more complex form, the shape of the part of the coupling part which is provided with the lips and which co-acts with the opening, is substantially complementary to the shape of the opening. In order to obtain a better clamping, the wall in a further preferred embodiment increases at least partially in thickness as seen in the rotation direction at the position of the opening.

A positioning edge is preferably arranged on at least one part of the peripheral edge of the opening.

In a following preferred embodiment means are provided for locking the components against further radial rotation. The means preferably comprise co-acting cams and recesses, which cams respectively recesses are arranged on the rear of the lips as seen in coupling direction and the recesses respectively cams co-acting therewith are arranged on the inside of the profile part adjacently of the opening at the position of the smaller dimension thereof.

In yet another preferred embodiment the material comprises plastic, preferably ABS (ABS=acrylonitrile-butadiene-styrene), ASA (ASA=acrylonitrile-styrene-acrylester-rubber) or a combination of ABS and PA (PA=polyamide). ABS and ASA have a good scratch-resistance and a great stiffness. ABS in particular has very good optical qualities, which provides the option of supplying the modular construction system in many different colors, wherein the color-fastness is ensured. ABS has the advantage compared to ASA that it is less expensive. The combination of ABS and PA has high color-fastness as well as a high degree of insusceptibility to wear.

BRIEF DESCRIPTION OF THE DRAWINGS

The invention will now be described in more detail with reference to the drawing, in which:

FIG. 12 shows an eleventh embodiment of the modular construction system according to the invention; and FIG. 13 shows a twelfth embodiment of the modular construction system according to the invention.

DETAILED DESCRIPTION OF THE PREFERRED EMBODIMENTS

Figure 1:
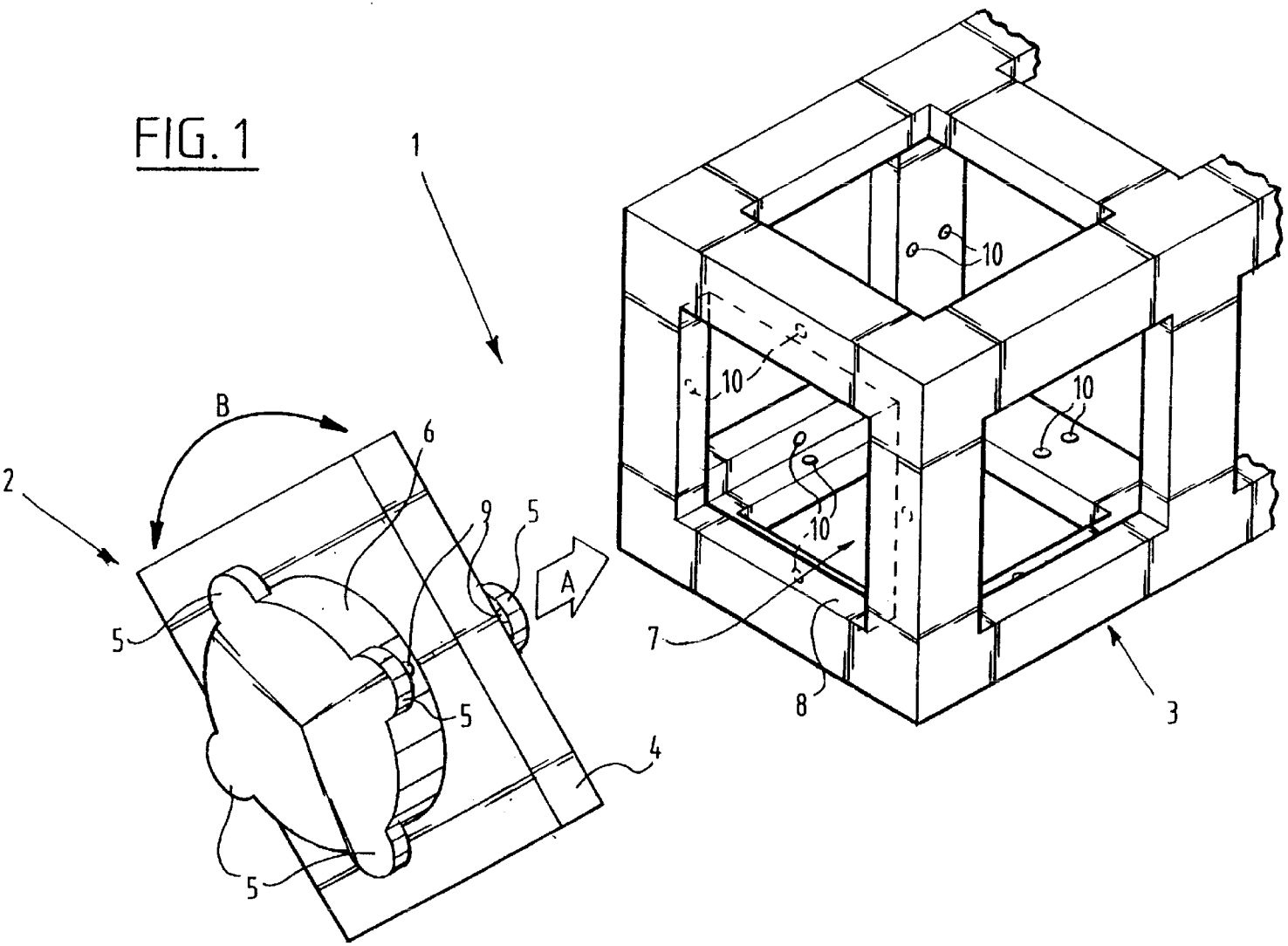
FIG. 1 shows a first embodiment of the modular construction system according to the invention.

FIG. 1 shows a first embodiment of the modular construction system 1 according to the invention. Construction system 1 comprises a coupling part 2 which can be coupled to a profile part 3. Component 2 is provided with a central part 4, on either side of which are arranged radially protruding lips 5. A recessed portion 6 is situated on either side between lips S and central part 4.

Component 3 is provided with a continuous opening 7 which has different dimensions as seen in at least two different radial directions. Opening 7 is in this example a square, which implies that opening 7 has different dimensions in two different radial directions. The largest dimension is between mutually opposite corner points of the square. The smallest dimension is between mutually opposite sides of the square. The maximum distance between lips 5 on component 2 is now chosen such that this is smaller than the distance between two mutually opposite corner points of opening 7 and larger than the distance between two mutually opposite sides of opening 7. As seen in coupling direction A, the depth of wall 8 of component 3 is smaller than or equal to the dimension of recessed portion 6 of component 2 as seen in coupling direction A.

Figure 2:
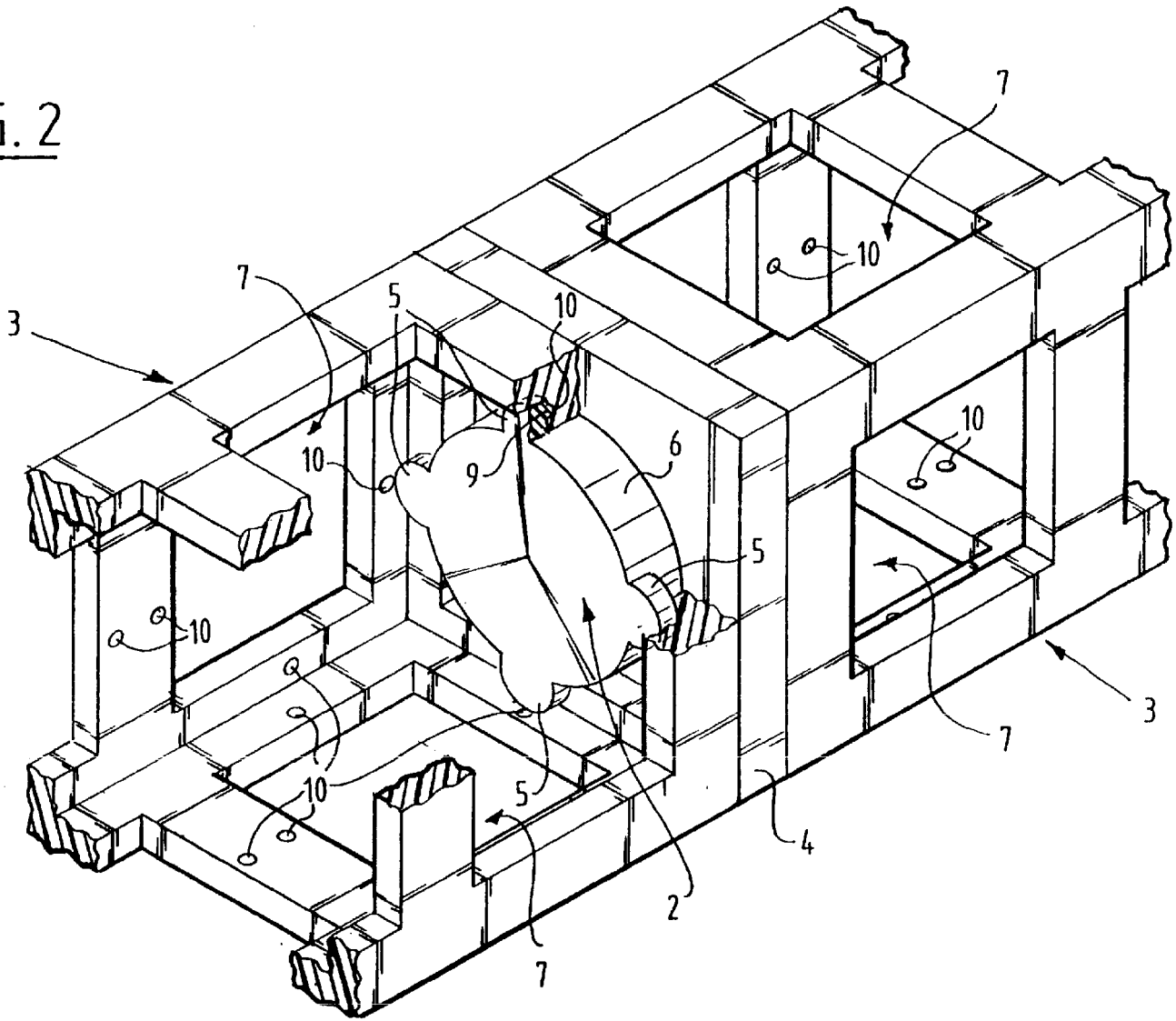
FIG. 2 shows different components of the first embodiment of FIG. 1 in coupled situation.

FIG. 2 shows the first embodiment of FIG. 1 in coupled situation. Coupling has taken place by inserting component 2 as far as possible into the continuous opening 7 of component 3, starting from the position as shown in FIG. 1. Coupling takes place by then rotating either component 2 or component 3 in radial direction as indicated by arrows B. Wall 8 of component 3 is herein received clampingly in recessed portion 6 of component 2.

In order to prevent undesired radial rotation of the coupled components relative to each other, lips 5 are provided on the rear side thereof as seen in coupling direction A with cams 9. These cams 9 can co-act with recesses 10 arranged on the inner side of component 3 adjacently of opening 7. Alternatively, recesses can of course be provided on the lips 5, wherein cams are provided on component 3. A choice is preferably made for a somewhat flexible material which can bend under the influence of force. A good clamping coupling can be obtained in this manner as well as a good locking. Another possibility includes the use of two protrusions spaced apart over a distance equal to or larger than the width of the lips, such that in coupled position each lip is held between said pair of protrusions (not shown).

As shown in FIG. 2, a component 3 can be coupled on either side of component 2. The cross-section through central part 4 further corresponds with a cross-section through component 3, so that in the coupled state components 2 and 3 have the same form.

Figure 3:
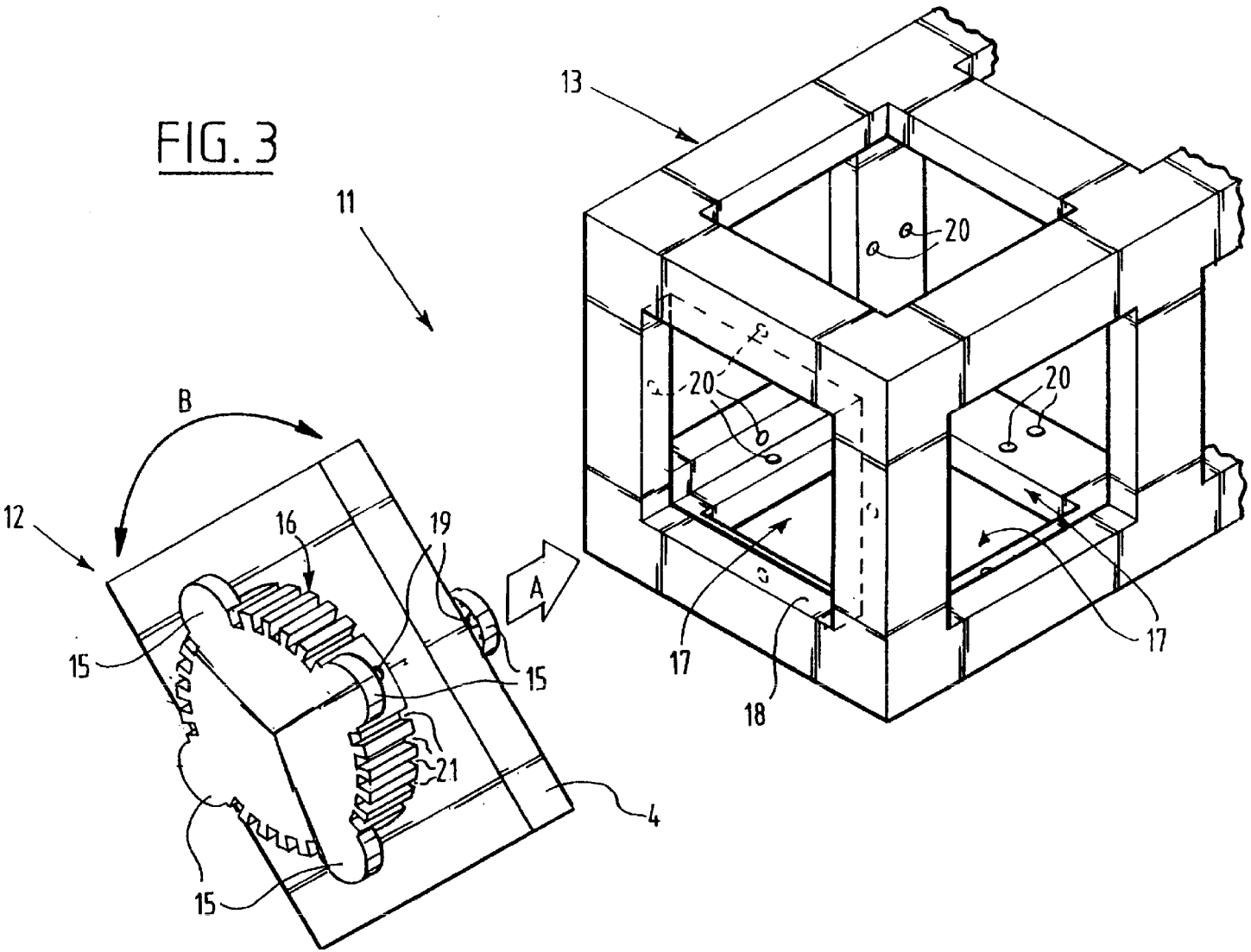
FIG. 3 shows a second embodiment of the modular construction system according to the invention.

FIG. 3 shows a second embodiment of modular construction system 11 according to the-invention. Construction system 11 bears a close resemblance to construction system 1 according to the invention. Identical components are provided with the same reference numerals increased by 10. The most significant difference between construction system 11 and construction system 1 lies in the fact that recessed portion 6 is provided with grooves 21 running in coupling direction A. These grooves provide the option of causing the radial rotation in the direction B to take place using a key 22, shown in FIG. 4, which is adapted for co-action with the grooves. Needless to say that instead of grooves all technical equivalent means providing a point or area of application for a tool can be used.

Figure 4:
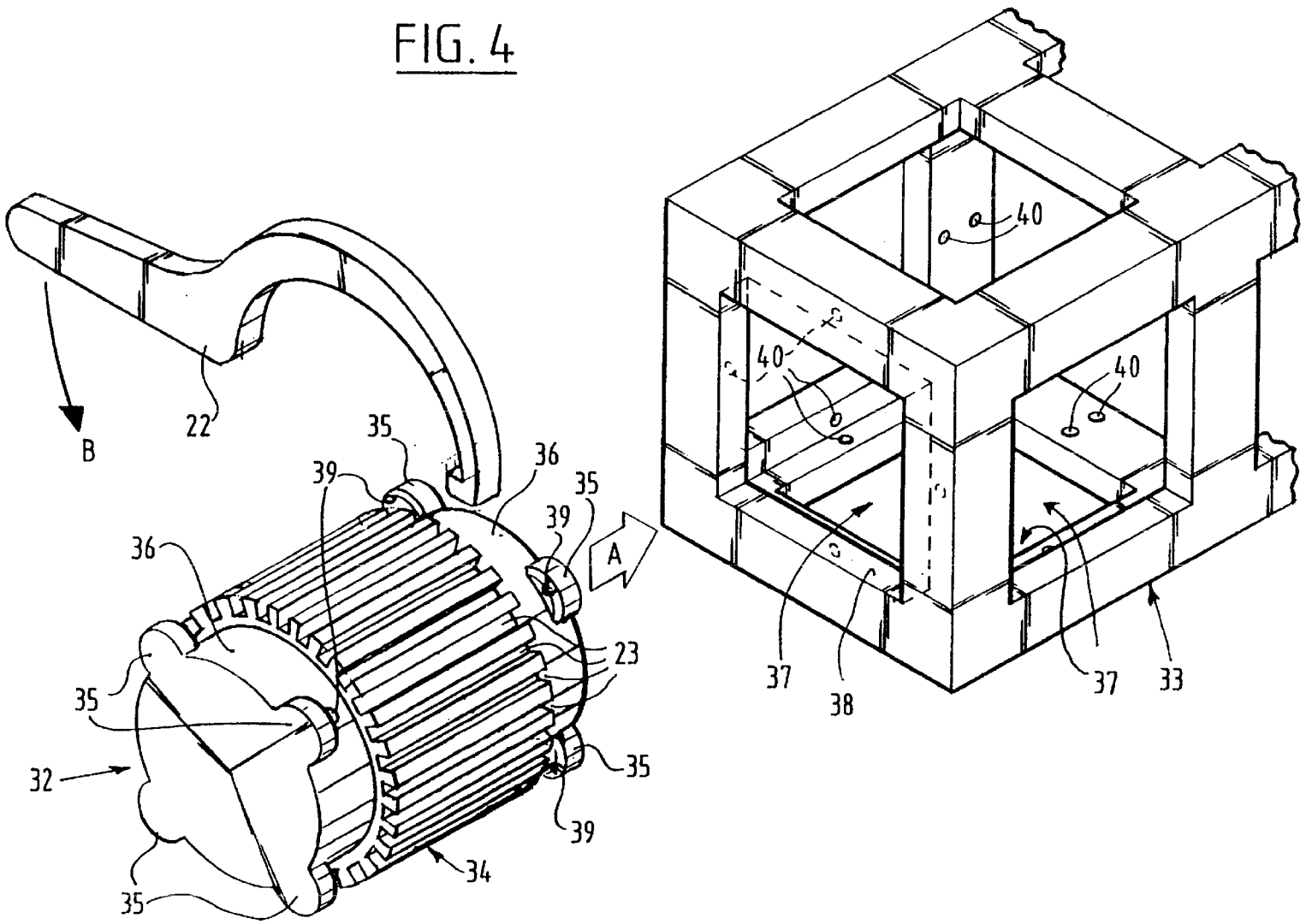
FIG. 4 shows a third embodiment of the modular construction system according to the invention.

FIG. 4 shows a third embodiment of modular construction system 31 according to the invention. Construction system 31 is largely similar to construction systems 1 and 11. Identical components are provided with the same reference numerals which are then increased by 30 relative to the reference numerals of FIG. 1. The most significant difference from the foregoing embodiments is that central part 34 has a circular cross-section and is provided with grooves 23 running in coupling direction A. As a result of these grooves 23 rotation of component 32 can likewise take place using key 22.

Figure 5:
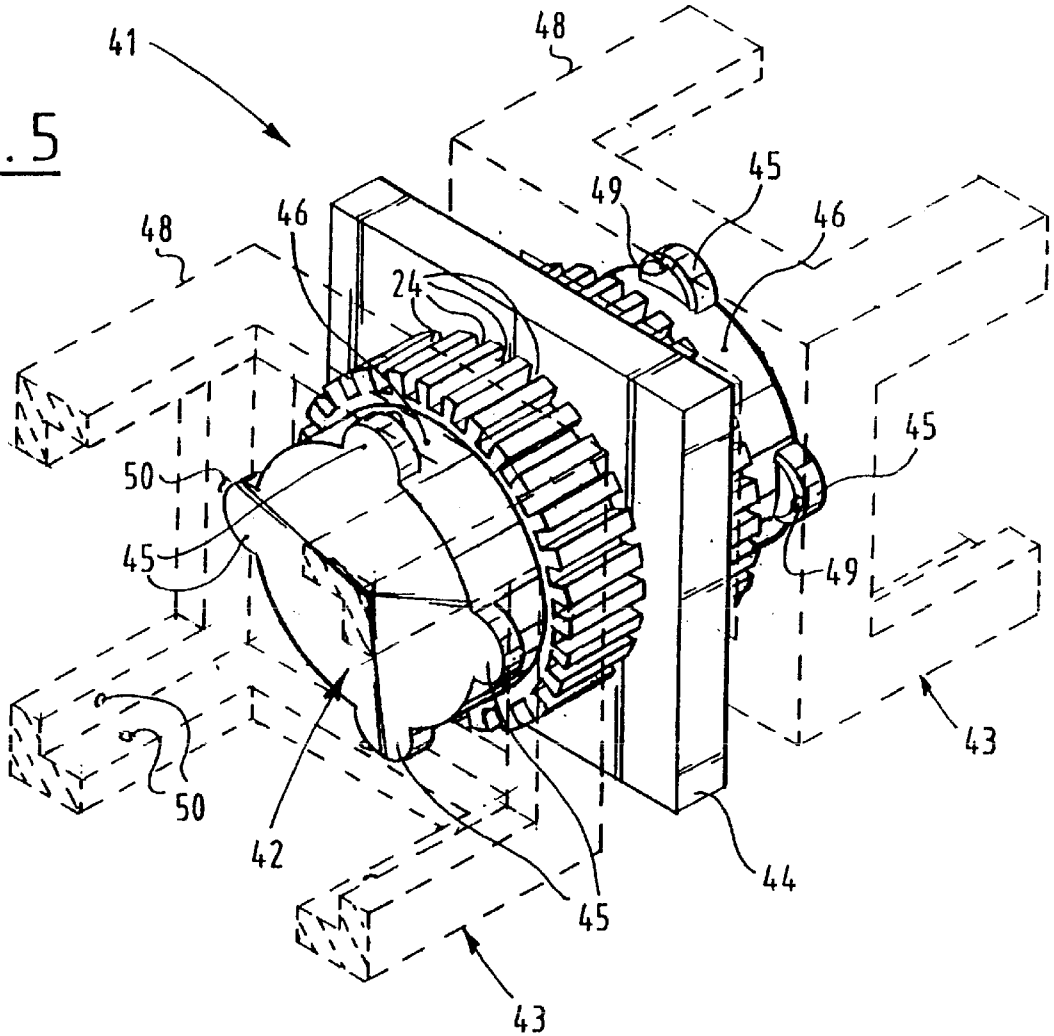
FIG. 5 shows a fourth embodiment of the modular construction system according to the invention.
Figure 6:
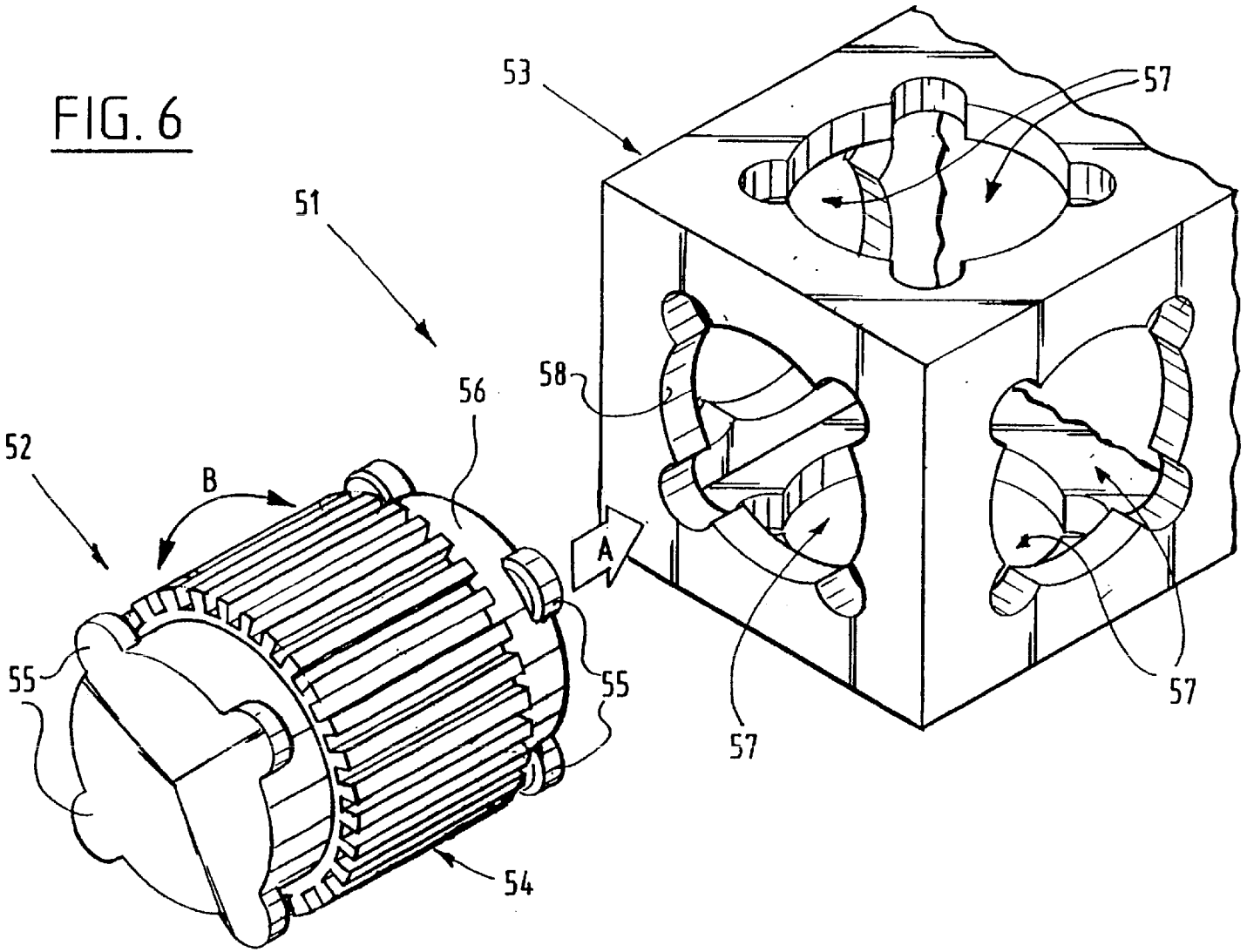
FIG. 6 shows a fifth embodiment of the modular construction system according to the invention.

FIG. 5 shows a fourth embodiment of modular construction system 41 according to the invention. Construction system 41 is a combination of construction systems 11 and 31. Identical components are provided with the same reference numerals which are then increased by 30 relative to FIG. 3. Construction system 41 has a central part 44 which consists of a part with a square section having on either side thereof two parts of circular section provided with grooves 24. The part with the square section is easy to rotate manually, while the parts of circular cross-section and grooves can be rotated using key 22. Wall 48 of component 43 can be arranged clampingly in recessed portion 46 of component 42 in the above described manner, which recessed portion is bounded by lips 45 and the circular part of central part 44. FIG. 6 shows a fifth embodiment of modular construction system 51 according to the invention. Construction system 51 shows the greatest similarity to construction system 31. Identical components are provided with the same reference numerals which are generally increased by 20 relative to FIG. 4. The most significant difference from the foregoing embodiments is that the shape of coupling edge 58 is complementary to the joint form of lips 53 and edge 56.

Figure 7:
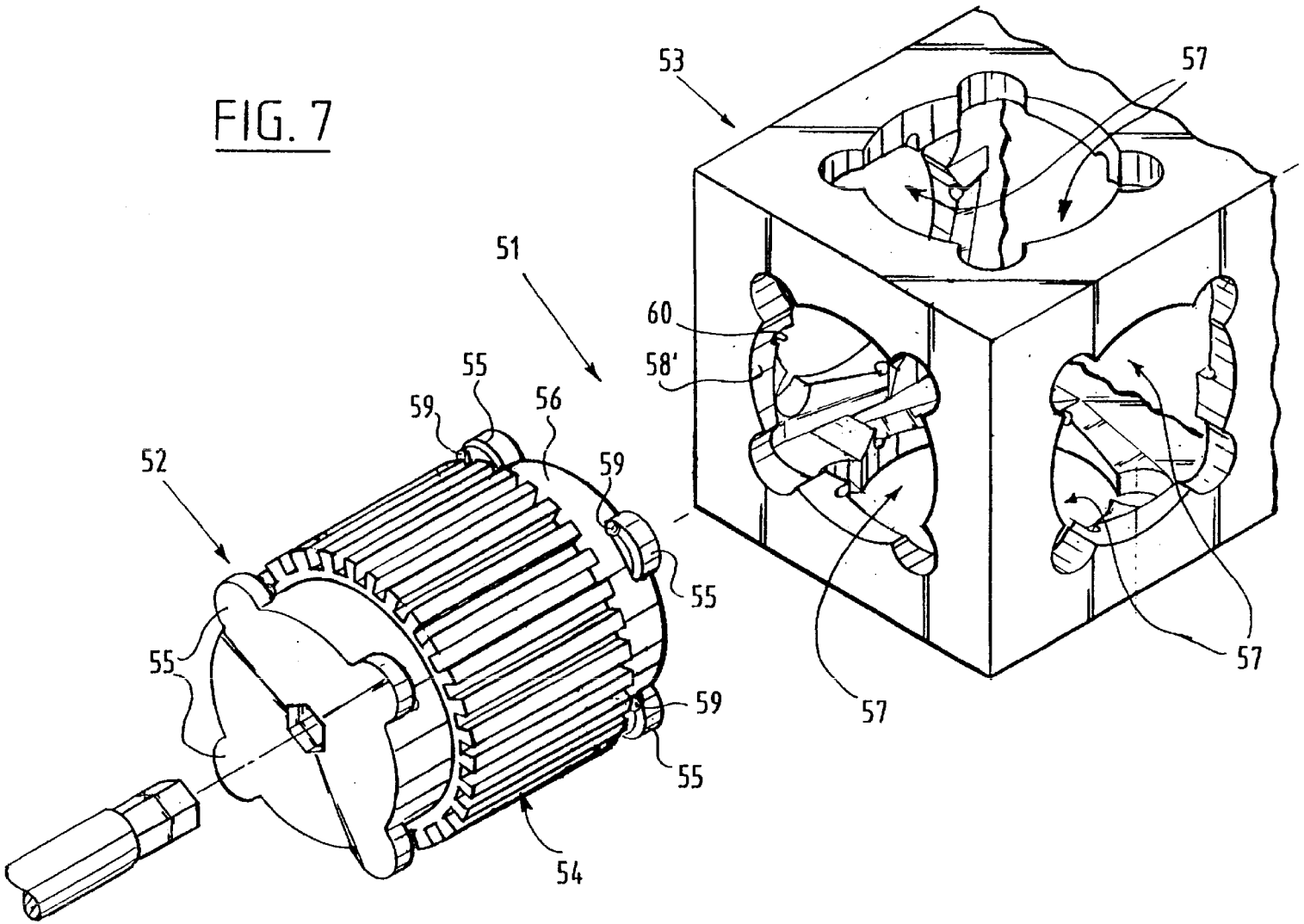
FIG. 7 shows a sixth embodiment of the modular construction system according to the invention.

FIG. 7 shows a sixth embodiment of the modular construction system according to the invention. This sixth embodiment greatly resembles the fifth embodiment 51 shown in FIG. 6. The first difference is found in the shape of the coupling edge, which is designated 58' to distinguish it. The thickness of coupling edge 58' increases as seen in the rotation direction, which in this example is clockwise. By rotating coupling part 52 relative to profile part 53 a coupling therefore results with increasing clamping. Preferably the thickness of coupling edge 58' is first maximal in order to prevent the coupling part 52 from falling out of the profile part 53 after the first initial coupling. Adjacent thereto the thickness of coupling edge 58' reduces to a minimum from which it increases as described before in the direction of rotation. A second difference is to be found in the cams 59 which are arranged on the rear of lips 55. These cams 59 co-act with snap recesses 60 to lock the coupled situation.

Figure 8B:
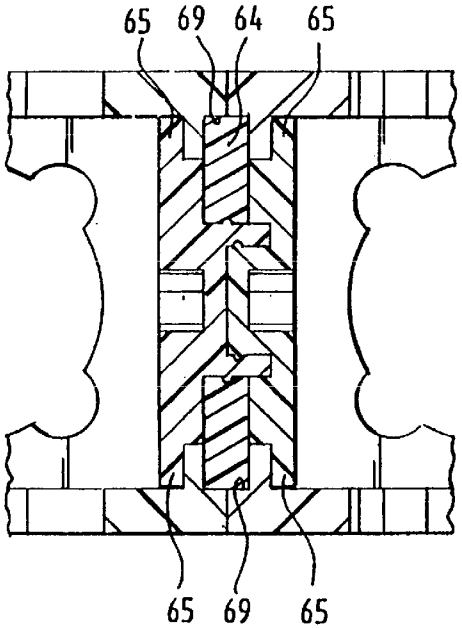
FIG. 8B shows the seventh embodiment partially in longitudinal section.
Figure 8A:
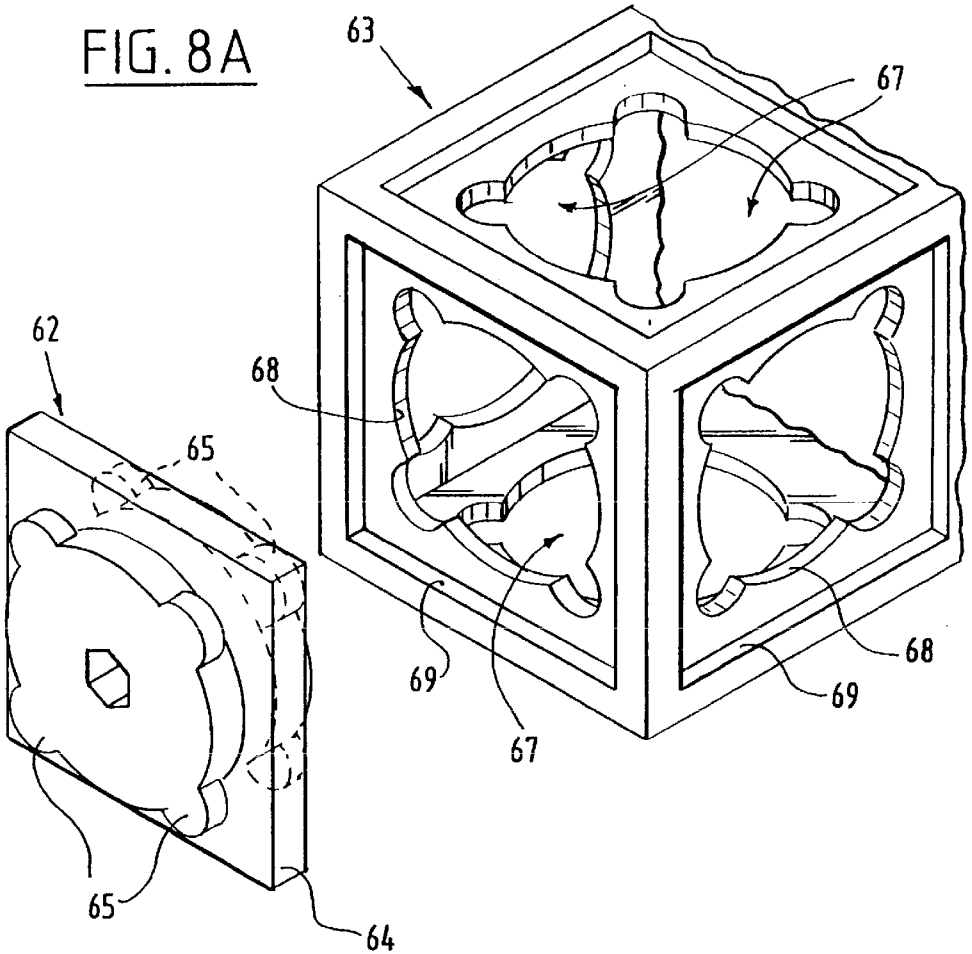
FIG. 8A shows a seventh embodiment of the modular construction system according to the invention.

FIG. 8A shows a seventh embodiment of modular construction system 61. Construction system 61 bears a close resemblance to construction system 1 of FIGS. 1 and 2. Identical components are provided with the same reference numerals increased by 50. Recesses 69 are provided in profile part 63 round openings 67 for receiving at least a portion of central part 64. Central part 64 is concealed from view in the coupled state of two profile parts 63. This is shown in FIG. 8B which shows in longitudinal section a portion of two coupled profile parts with a coupling part therebetween. In order to effect the rotatable coupling, lips 65 are rotatably mounted on either side of central part 64. A hole 70 is provided for rotation of lips 65 by means of a tool (not shown). A suitable tool is preferably designed such that it can be inserted through one of the other openings 67 in profile part 63 so as to engage on hole 70 in order to rotate lip 56 for coupling or decoupling of coupling part 62.

Figure 9:
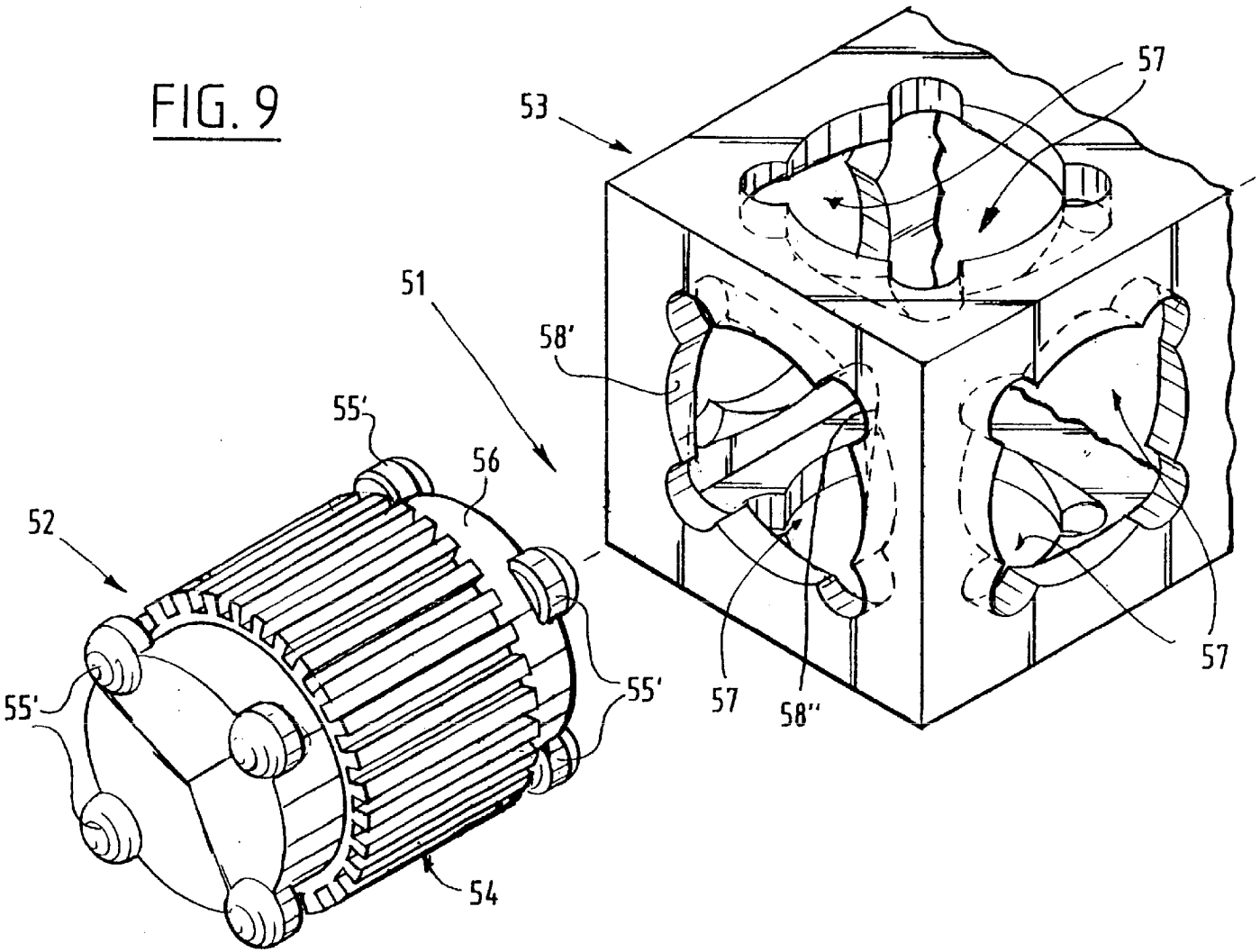
FIG. 9 shows an eighth embodiment of the modular construction system according to the invention.

FIG. 9 shows an eighth embodiment of the modular construction system according to the invention. The eighth embodiment closely resembles the sixth embodiment shown in FIG. 7. Identical components are provided with the same reference numerals. Differences are to be found in the coupling lips and the coupling edge, this being indicated by means of accents added to the reference numerals. Coupling edge 58' is provided with four "ears" for co-action with lips 55' on coupling part 52. The shape of coupling edge 58' is generally complementary to the shape of the portion of coupling part 52 provided with lips 55'. The ears are each provided with a positioning edge 58" which is formed such that it facilitates realization of the coupled situation. Lips 55' are provided for this purpose with a rounded shape. The position edge 58" can be situated on both sides of the opening as can the rounded shape of lips 55' be situated on one or both sides of the lips.

Figure 10:
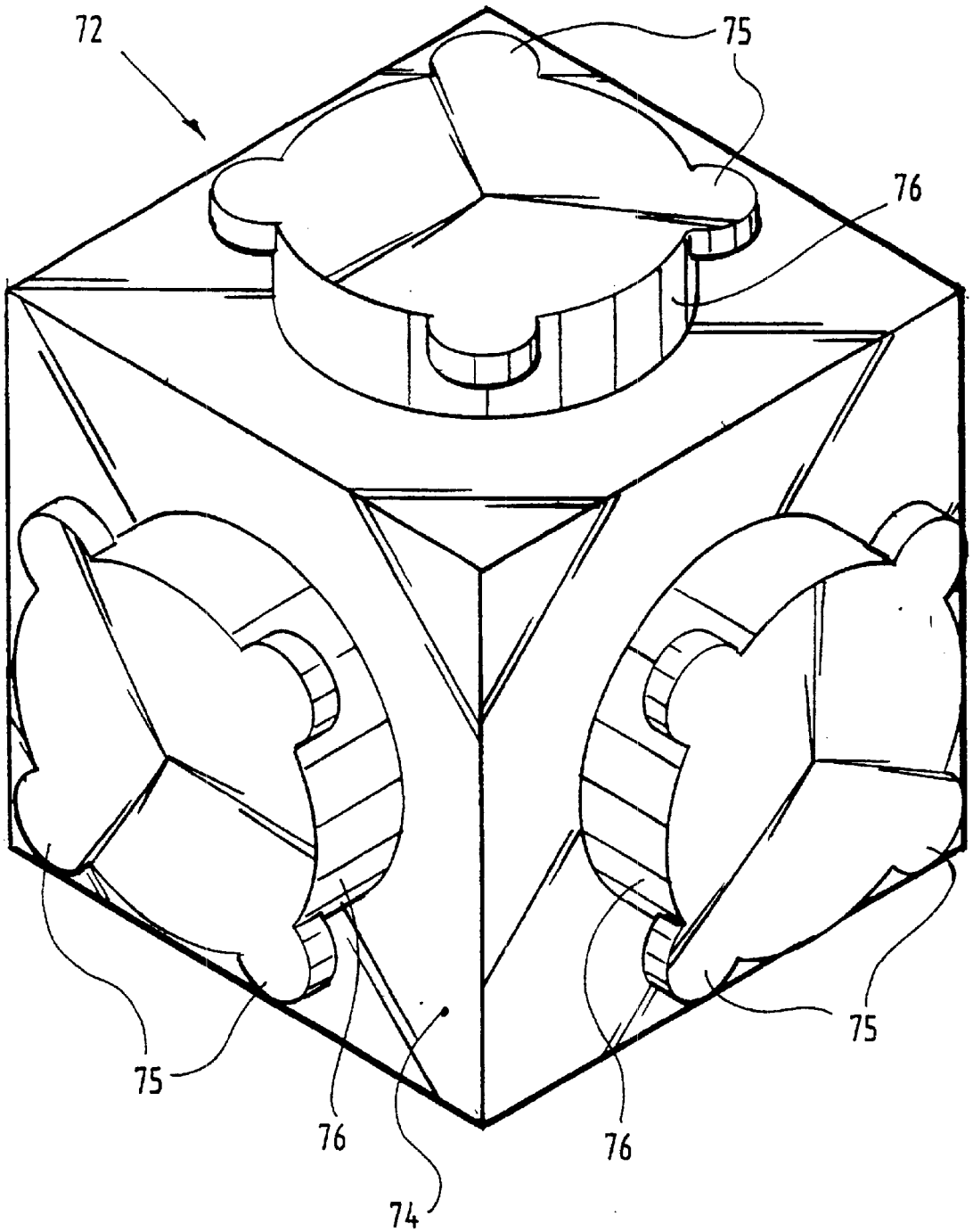
FIG. 10 shows a ninth embodiment of the modular construction system according to the invention.

FIG. 10 shows a ninth embodiment of the modular construction system according to the invention. Only coupling block 72 is shown. This coupling block has a cube-shaped central part 74. Sets of four lips 75 are arranged hereon on all six sides. A recessed portion 76 adjoins each set of lips 75.

Figure 11:
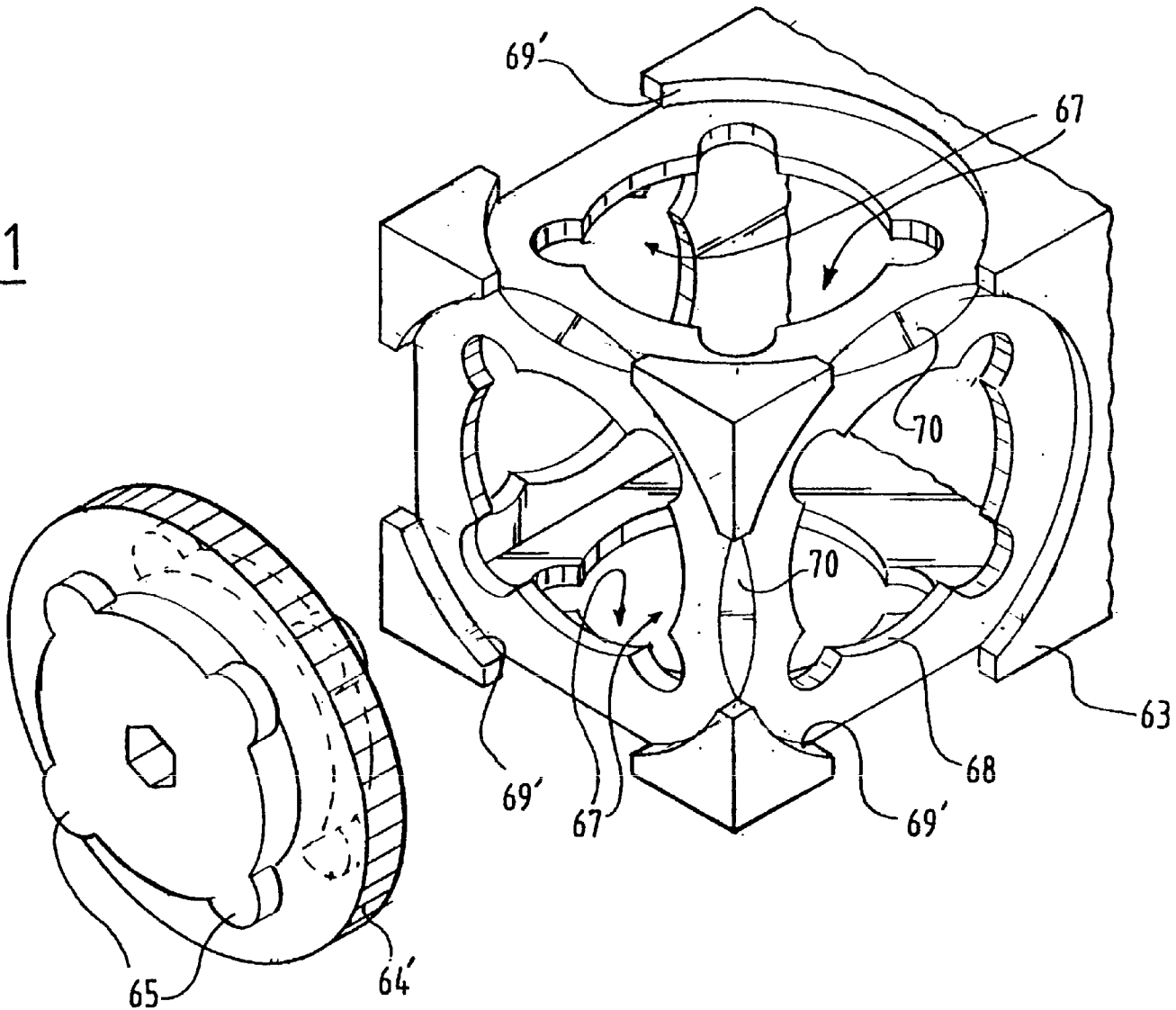
FIG. 11 shows a tenth embodiment of the modular construction system according to the invention.

FIG. 11 shows a tenth embodiment of the modular construction system according to the invention. The tenth embodiment closely resembles the seventh embodiment shown in FIGS. 8A en 8B. The difference lies in the round shape of central part 64' and the corresponding round shape of recess 69'. Openings 70 are provided in the profile part 63, such that central part 64' can be rotated in the coupled position. Relevant markings can be applied on central part 64' to discriminate between the open and locked position.

FIG. 12 shows a completely different embodiment which also falls within the scope of the invention. Coupling part 82 is provided with radially inwardly projecting lips 85. Corresponding openings 87 are provided on profile part 83. In analogy with the preceding embodiments the depth of wall 88 is smaller than or equal to the dimension of recessed portion 86 behind lips 85. Coupling takes place by relative rotation of the parts with respect to each other. No resilience is required of lips 85.

This last embodiment leads to a way of practicing the idea according to the invention which can be generally applied to the preceding embodiments of FIGS. 1 through 11. One part can be provided with radially inwardly protruding "lips", which are situated along the peripheral edge of an opening 97. The general shape of this opening can also be found on a second part 92 to be coupled with the first part, but in complementary form, comprising lips 95 followed by a resessed portion 96. In terms of the introduced definitions the first part now corresponds to the profile part and the second part now corresponds to the coupling part. This embodiment is schematically shown in FIG. 13. For completeness sake it must be noted that parts of the modular construction system according to the invention can be provided with the lips on one side as well as with an opening on another side thereby creating "hybrid" parts which are coupling parts as well as profile parts.

Although the invention is illustrated with reference to an example in which four lips and a square or complementarily formed opening are shown in each case, it will be apparent to the skilled person that a coupling part with at least one lip and a profile part with a non-round opening will be sufficient to obtain a working embodiment. The coupling part is preferably provided with two or more lips.

In addition, the construction system according to the invention is also particularly suitable for application in systems for shop fittings, for instance to couple components thereof such as racks and the like.

The present invention is not of course limited to the described and illustrated embodiments, but also comprises, in addition to all conceivable combinations thereof, any other embodiment which is consistent with the foregoing description and the annexed drawings and which falls within the scope of the appended claims.

What is claimed is:

1. A modular construction system, comprising at least two profile parts for mutual releasable coupling by means of a coupling part, wherein the coupling part is provided on at least two different sides thereof with one or more radially protruding lips and a reduced radial section adjacent to and coplanar with the protruding lips, wherein the reduced radial section further includes a recessed portion present behind the lips as seen in coupling direction, and wherein each profile part is provided in at least one wall thereof with a continuous opening with different dimensions as seen in at least two different radial directions, wherein the larger dimension is larger than or equal to the maximum radial section through the lips and wherein the smaller dimension is smaller than said maximum radial section but larger or equal to said reduced radial section, wherein the wall thickness at the position of the opening is smaller than or equal to the width of the recessed portion on the coupling part, such that coupling takes place by freely positioning of the lips in the opening and by subsequent radial rotation of the coupling part and each profile part relative to each other to engage the lips against, at least one wall of the profile part thereby securing the coupling part and one profile part together.

2. The modular construction system as claimed in claim 1, wherein the coupling part is provided with two or more lips on each of the at least two different sides.

3. The modular construction system as claimed in claim 1, wherein the coupling part is provided with four lips on each of the at least two different sides.

4. The modular construction system as claimed in claim 1, wherein the coupling part comprises at least two sets of one or more lips fixed to a central part, wherein the recessed portion associated with each set of lips is bounded by the lips and the central part.

5. The modular construction system as claimed in claim 1, wherein the coupling part is embodied mirror-symmetrically as seen in transverse direction.

6. The modular construction system as claimed in claim 4, wherein the central part and the profile part each have a transverse shape and wherein the transverse shape of the central part is substantially the same as the transverse shape of the profile part.

7. The modular construction system as claimed in claim 4, wherein each profile part in the wall provided with the opening has a recess for receiving at least a portion of the central part.

8. The modular construction system as claimed in claim 4, wherein grooves running parallel to the coupling direction are arranged on the central part.

9. The modular construction system as claimed in claim 4, wherein the central part has the shape of a cube.

10. The modular construction system as claimed in claim 9, wherein a set of one or more lips is arranged on all six sides of the cube-shaped central part.

11. The modular construction system as claimed in claim 9, wherein the form and dimensions of at least one of the walls of each profile part provided with the opening are the same as the form and dimensions of at least one of the sides of the cube-shaped central part.

12. The modular construction system as claimed in claim 4, wherein the sets of lips are mounted rotatably on the central part.

13. The modular construction system as claimed in claim 1, wherein the opening has a square shape.

14. The modular construction system as claimed in claim 1, wherein the part of the coupling part which is provided with the lips and which co-acts with the opening has a shape substantially complementary to the shape of the opening.

15. The modular construction system as claimed in claim 1, wherein the wall increases at least partially in thickness in the direction of radial rotation at the position of the opening.

16. The modular construction system as claimed in claim 1, wherein the opening has a peripheral edge and wherein a positioning edge is arranged on at least one part of the peripheral edge of the opening.

17. The modular construction system as claimed in claim 1, wherein means are provided for locking the profile parts with the coupling part to resist further radial rotation.

18. The modular construction system as claimed in claim 17, wherein the means comprise co-acting cams and recesses, wherein the cams are arranged on the rear of the lips as seen in coupling direction and the recesses are arranged on the inside of the profile part adjacent to the opening.

19. The modular construction system as claimed in claim 1, wherein the profile parts and the coupling part are made of plastic.

20. The modular construction system as claimed in claim 19, wherein the plastic comprises ABS, ASA or a combination of ABS and PA.

* * * * *

UNITED STATES PATENT AND TRADEMARK OFFICE

CERTIFICATE OF CORRECTION

PATENT NO. : 6,595,825 B1
DATED : July 22, 2003
INVENTOR(S) : Gerrit Jan De Wilde It is certified that error appears in the above-identified patent and that said Letters Patent is hereby corrected as shown below:

Title page,
Item [87], PCT Pub. Date, "May 4, 1999" should read -- May 14, 1999 --.

Column 3,
Line 34, "lips S" should read -- lips 5 --.

Column 4,
Line 12, "the-invention" should read -- the invention --.

Column 6,
Line 56, "against," should read -- against --.

Signed and Sealed this

Twenty-seventh Day of January, 2004

JON W. DUDAS
*Acting Director of the United States Patent and Trademark Office*